United States Patent [19]

Contreras et al.

[11] 4,345,607

[45] Aug. 24, 1982

[54] SPRING LATCH AND HINGE ASSEMBLY FOR CLOSURE MEMBERS

[75] Inventors: Joseph P. Contreras, Mendham; George J. Sass, Bloomingdale, both of N.J.

[73] Assignee: Corona Plastics, Inc., Denville, N.J.

[21] Appl. No.: 211,216

[22] Filed: Nov. 28, 1980

[51] Int. Cl.[3] ..... A45D 33/00

[52] U.S. Cl. ..... 132/83 R

[58] Field of Search ..... 206/814, 823; 220/DIG. 26, DIG. 14; 132/82, 82 E, 83, 83 E, 79 F, 79 G, 82 R, 82 C, 83 C, 83 F, 83 A, 83 B, 83 D, 83 G, 83 H

[56] References Cited

U.S. PATENT DOCUMENTS 1,950,465 3/1934 Whitlock ..... 132/83 R 3,776,245 12/1974 Hayes et al. ..... 132/82 F

FOREIGN PATENT DOCUMENTS 780228 7/1957 United Kingdom ..... 132/83 R

*Primary Examiner*—Gene Mancene

*Assistant Examiner*—Wenceslao J. Contreras

*Attorney, Agent, or Firm*—Daniel H. Bobis

[57] ABSTRACT

A spring latch and hinge assembly for closure members generally on containers such as compacts for powder and other cosmetics includes spaced hinge elements on one peripheral side of the closure or cover member and base members to permit pivotal movement of the closure or cover member from open to closed position relative the base member and resilient elements alternatively on the base member or the closure member whose resilience is a function of the coefficient of elasticity of the materials from which the closure or cover member and base member are made; said resilient elements disposed between the spaced hinge members and constructed with a designed resistance to closing which compresses the resilient element and establishes a predetermined expansion force therein to resist opening of the closure or cover member from the closed position. The closing and opening movement of the closure member produces an audible clicking sound by the resilient elements.

12 Claims, 36 Drawing Figures

SPRING LATCH AND HINGE ASSEMBLY FOR CLOSURE MEMBERS

BACKGROUND OF THE INVENTION

This invention relates generally to closure members such as the closure members on compacts for cosmetics or other containers and more particularly to a combined spring latch and hinge assembly for pivotally connecting such closure members into operating position which offers a designed resistance to the movement of such closure member from closed to opened position.

Compacts for powder, rouge and other cosmetics are well known devices and conventional prior art compacts have the closure or cover member pivotally hinged to the base member for movemnent of the cover member from open to closed position so that they require a conventional interference type clasp unit for sealing the closure or cover member to the base member which interference clasp unit will be located a spaced distance generally opposite from the pivotal hinge means provided on the compact.

Various prior art containers for use as compacts or vanity cases are known wherein the pivotal hinge means and the clasp or latching assembly are disposed at the same side or edge of the compact as is shown in U.S. Pat. Nos. 2,527,318 and 2,404,558.

The present invention seeks to provide a unique and improved spring latch and hinge mechanism for compacts or other containers in which designed forces are established to provide a predetermined closed pressure and a designed resistance to closing and to opening of the closure or cover member with respect to the associated base member on which the closure member is pivotally connected, by taking advantage of the inherent strength and thermal plastic memory of the plastic materials from which the compacts are molded.

SUMMARY OF THE INVENTION

Thus, the present invention covers an improved spring latch and hinge assembly for a closure means such as the cover member for a container having a base member with a chamber for cosmetics and other purposes including, spaced hinge means having hinge elements respectively on the closure means and the base member to pivotally connect the closure means to said base member, at least one resilient element operatively disposed between the spaced hinge means, and a coacting latch means to exert force on said resilient means and to place the same under compression during movement of the closure means to the closed position to provide a predetermined expansion force to resist opening movement of the latch means.

The improved spring latch and hinge assembly as above described wherein the material from which either the closure means or the base member are made has a coefficient of elasticity to provide the desired resiliency for the resilient element.

And, the improved spring latch and hinge assembly as above described wherein an audible clicking sound occurs on closing and opening movement of the closure means.

Accordingly, it is the principal object of the present invention to provide a spring latch and hinge assembly for a container in which the resistance to closing, the resistance to opening, and the forces for maintaining the closure member for the container closed is established by coacting forces acting between the hinge mechanism and suitable resilient means on the closure member and its associated base member.

It is another object of the present invention to provide a container having an improved spring latch and hinge assembly which requires a predetermined force to move the closure member of the container to the closed position and has a designed resistance to the opening of the closure without requiring the use of a conventional interference clasp of any kind.

It is another object of the present invention to provide an improved spring latch and hinge assembly for the closure on a container or an associated base wherein on movement to the closed position or to the open position an audible click or snap occurs during the use of the container.

Other objects and advantages of the present invention will become apparent from the following description taken in conjunction with accompanying drawings showing several embodiments of the invention in which:

DESCRIPTION OF THE FIGURES

FIG. 9*b* is a front view of the closure or cover member shown in FIG. 8*a*.

Referring to the drawings FIGS. 1 to 8 illustrate the base spring latch and hinge assembly for closure members in accordance with the present invention in which the container is shown in the form of a compact generally designated 10.

Figure 1:
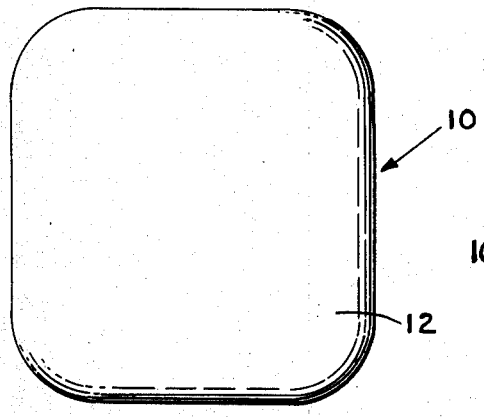
FIG. 1 is a top plan view of a container having a spring latch and hinge assembly for the closure or cover member thereon in accordance with the present invention.
Figure 2:
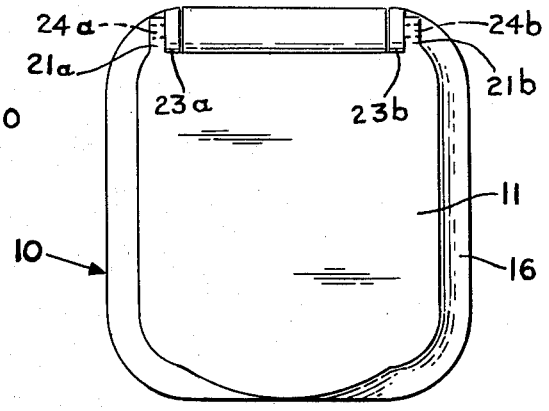
FIG. 2 is a botton plan view of the container shown in FIG. 1.

It will be understood by those skilled in the art that while the present invention is being illustrated as applied to compacts for powder, rouge or other cosmetics, that it is equally applicable to any type of closure in which a designed resistance to movement of the closure from the closed to open position is required.

Thus the compact 10 has a base or bottom member 11 and an associated closure or top member 12.

The base 11 and closure 12 are preferably molded from plastic materials such as polypropylene, acrylonitrile-butadiene-styrene (ABS) and polycarbonate having the strength and thermal plastic memory to provide the improved resilient latch and hinge assembly generally designated 20 for pivotally connecting the closure or top member 12 to the base or bottom member 11 as is more fully described hereinafter. Further, while the compact illustrated is square in plan view it will be understood by those skilled in the art that the shape and size of the particular container which utilizes the improved resilient latch and hinge assembly in accordance with the present invention will be in accordance with the commercial requirements for devices of this type.

Base or bottom member 11 includes a center section 13 which defines a chamber or receptacle 14 for powder, rouge or the like type of granular cosmetic which receptacle 14 has an open end as at 15 at the upper section of the center section 13. Circumferentially disposed and intergrally formed about the open end of the center section 13 is an annular flange section 16 which has a substantially flat sealing surface or upper face as at 17 as is shown in FIGS. 3, 7*a*, 7*b*, 7*c* and 7*d* of the drawings.

Closure or top member 12 is substantially semi-spherical to define a cavity 18 which is adapted for various purposes such as the mounting of a mirror, not shown. At the lower end of the top member 12 about the cavity 18 an annular flat rim 19 is formed which will form a seal with the upper surface 17 of the annular flange 16 as will appear clear from the description of the operation of the compact as also set forth below.

The closure or top member 12 is pivotally connected to and operatively associated with the base or bottom member 11 by means of the improved spring latch and hinge assembly of the present invention so that it can pivot alternatively to an open position to permit access to the opening 15 for the chamber or receptacle 14 and to a closed position when the annular flat rim 19 will coact with the upper face 17 of the annular flange section 16 to seal the opening of the receptacle 14 as will appear clear from the operation of the compact as described below.

FIGS. 4, 4*a*, 5, 6*a* and 6*b* show that in this form of the invention the improved spring latch and hinge assembly 20 includes snap-in pin type hinges wherein the respective hinge elements are molded as integral parts of the respective base member and closure member.

Figure 8A:
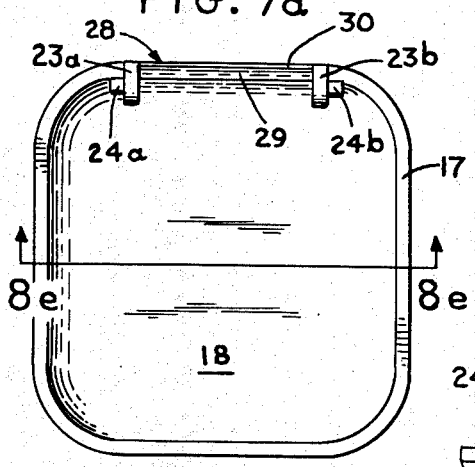
FIG. 8*a* is an inverted plan view of only the closure or cover member of the container shown in FIG. 1.
Figure 8C:
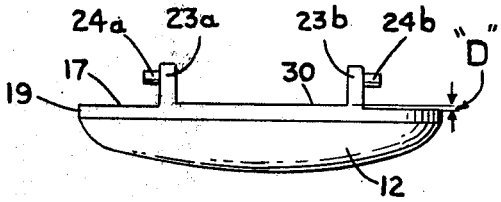
FIG. 8*c* is a rear view of the closure or cover member shown in FIG. 8*a*.
Figure 8B:
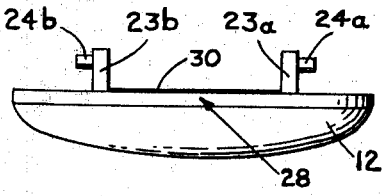
Figure 8D:
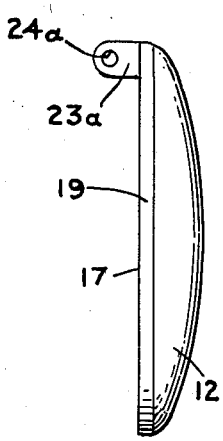
FIG. 8*d* is a right side view of the closure or cover member shown in FIG. 8*a*.
Figure 8E:
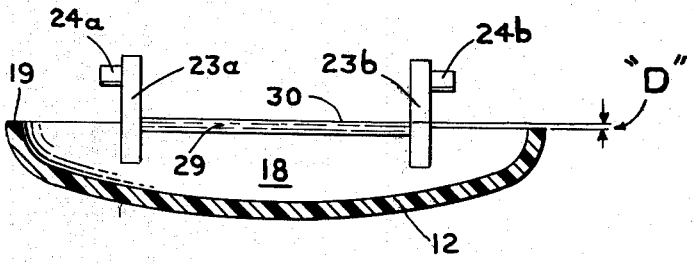
FIG. 8*e* is a cross-section taken on line 8*e*—8*e* of FIG. 8*a*.
Figure 9:
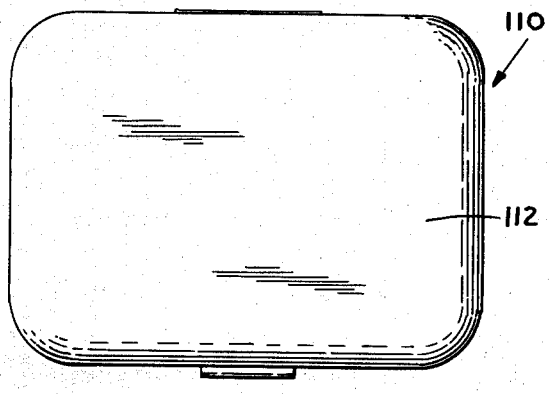
FIG. 9 is a top plan view of a container having another form of spring latch and hinge assembly for the closure or cover member thereon in accordance with the present invention.
Figure 10:
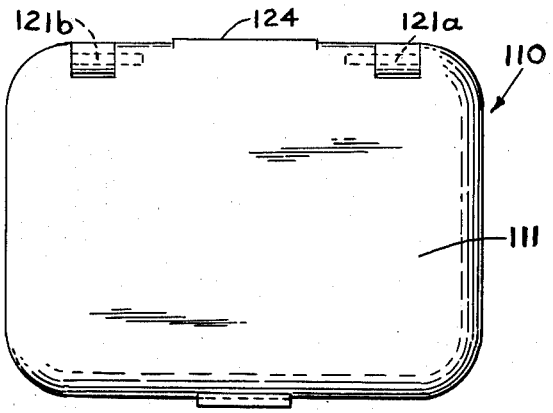
FIG. 10 is a bottom plan view of the container shown in FIG. 9.
Figure 11:
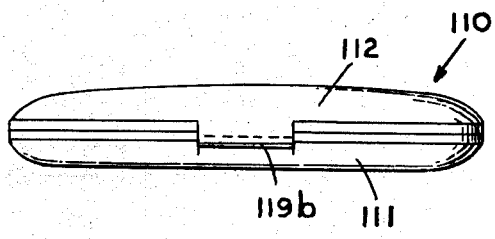
FIG. 11 is a front view of the container shown in FIG. 9.
Figure 12:
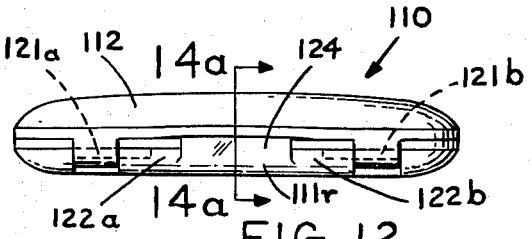
FIG. 12 is a rear view of the container shown in FIG. 9.
Figure 13:
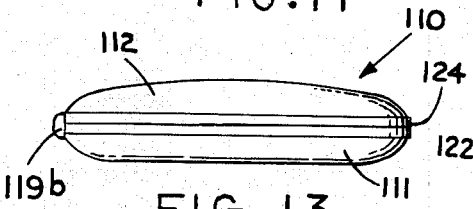
FIG. 13 is a right side view of the container shown in FIG. 9.
Figure 12A:
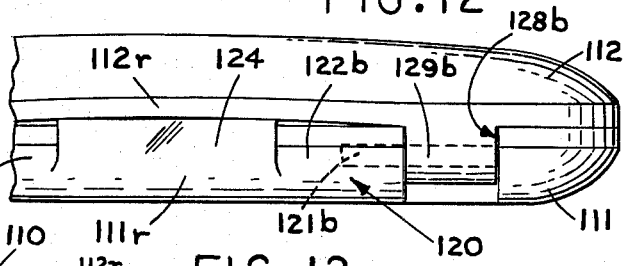
FIG. 12*a* is an enlarged view of one hinge and a portion of the spring latch adjacent thereto on the container as shown in FIG. 12.

Thus on the rear or back side of the base or bottom member 11 spaced hinge supports 21*a* and 21*b* having snap-in pin openings as at 22*a* and 22*b* extend radially outward and parallel to each other from the central section 13 of the base 11 to the peripheral edge of the annular flange 16 to which these hinge supports 22*a* and 22*b* are respectively connected. Similarly on the closure member 12 spaced pin supports as at 23*a* and 23*b* having pins 24*a* and 24*b* thereon extending in opposite directions from each other, are molded so that they lie in the edge of the cavity 18 and in engagement with the annular rim 19 as is clearly shown in FIG. 8*e*. The back edge of the respective pin supports 23*a* and 23*b* lying flush with the back edge of the closure or top member 12 and depending downwardly from the annular rim 19 for a predetermined length to permit the pins 24*a* and 24*b* to fit into the snap-in pin openings 22*a* and 22*b* so as to allow the closure or top member 12 to pivot or swing in an arc about the axis of rotation for the pins when they are in assembled position in the snap-in openings of the hinge supports.

For this purpose inboard of each of the respective hinge supports 21*a* and 21*b* spaced slots 25*a* and 25*b* are cut or milled in the annular flange 16 so that they extend radially inward from the peripheral edge of the annular flange 16 just short of the central section 13 so that the innermost portion of the annular flange 16 still remains continuous with the portion thereof which surrounds the opening 15 for the receptacle 14 formed in the central section and the remaining portion lying between the hinge supports 21*a* and 21*b* defines a resilient tab or spring leaf member 26 all of which is clearly shown in FIGS. 2, 4, 4*a*, 6*a*, 6*b*, 6*c*, 7*a* and 7*c* of the drawings.

The downwardly depending pin supports 23*a* and 23*b* will be spaced on centers identical with the spacing of the slots 25*a* and 25*b* and therefore will fit into these slots so that the pins 24*a* and 24*b* can be snapped into the snap-in openings 22*a* and 22*b* in the hinge supports 21*a* and 21*b* to form the means for pivotally connecting the closure or top member 12 to the base or bottom member 11 so as to permit the arcuate movement thereof relative the base or bottom member as above described.

Those skilled in the art will recognize that if the conventional interference catch of some type is not provided at the front edge of the compact 10 that the closure 12 will not seal the opening 15 of the receptacle 14 formed in the base or bottom member 11.

This is accomplished in the illustrated form of the invention shown in FIGS. 1 to 8 of the drawings by modifying the annular rim at the portion thereof between the depending pin supports 23*a* and 23*b* to form a latch section 28 which as shown in FIGS. 4*a*, 6*a*, 6*b*, 8*a*, 8*b* and 8*e* has a curved cove section 29 and a small incremental increase thickness on the edge as at 30 in the latch section 28 which creates a plane at the edge 28 between the depending pin supports that differs from the plane of the annular rim by a predetermined amount generally designated D in the order of 0.010" which amount can be varied for reasons that will appear clear from the description of the co-action between the edge 28 and the resilient tab or spring latch 26 formed between the slots 25*a* and 25*b* in the rear section of the annular flange 16 on the base member 11.

OPERATION FIG. 1 TO FIG. 8 FORM OF THE INVENTION

Figure 6C:
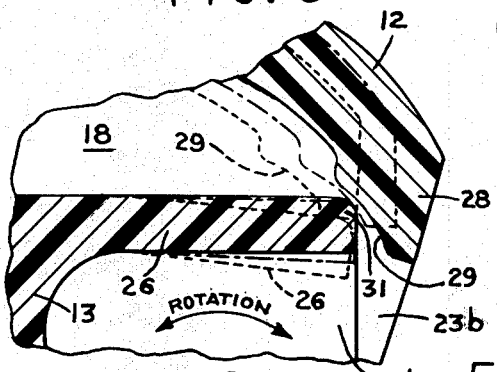
FIG. 6*c* is a still further enlargment of the cross-section of the spring latch portion on the container shown in FIG. 6*a*.
Figure 6B:
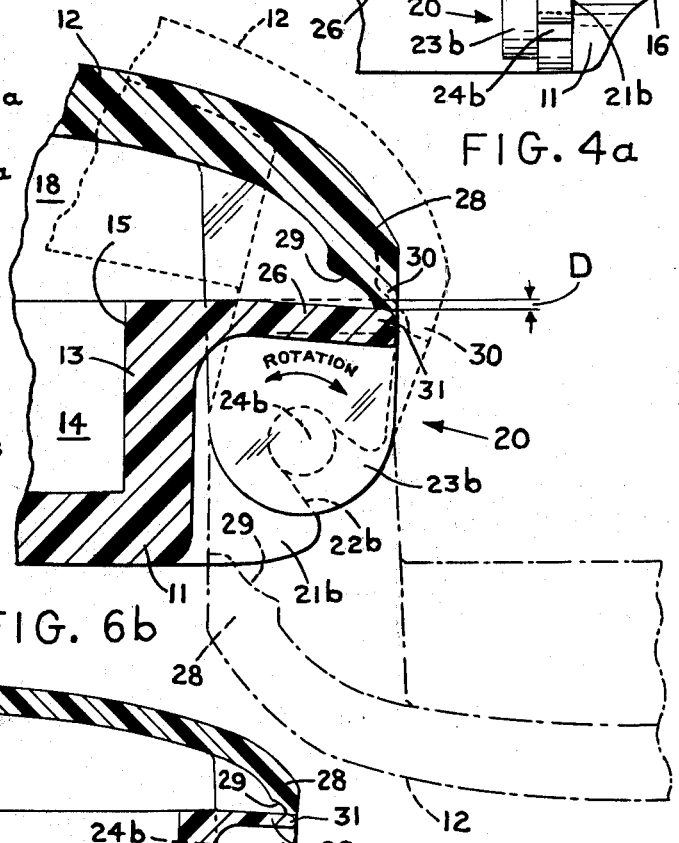
FIG. 6*b* is a partial enlarged cross-section taken at the spring clasp and hinge assembly end of the container as shown in FIG. 6*a* with the closure or top member shown relative the base or bottom member in the intermediate position by the phantomized dashed lines and in the open position by the dashed and dotted lines.
Figure 6A:
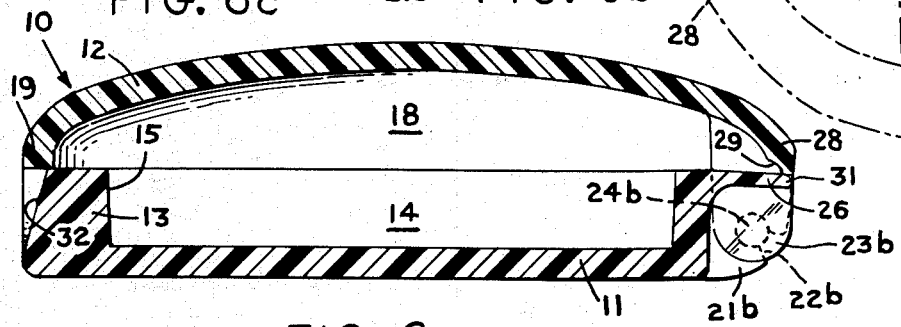
FIG. 6*a* is a cross-section taken on line 6*a*—*a* of FIG. 4 showing the base or top member and the closure or bottom member in closed position.
Figure 7A:
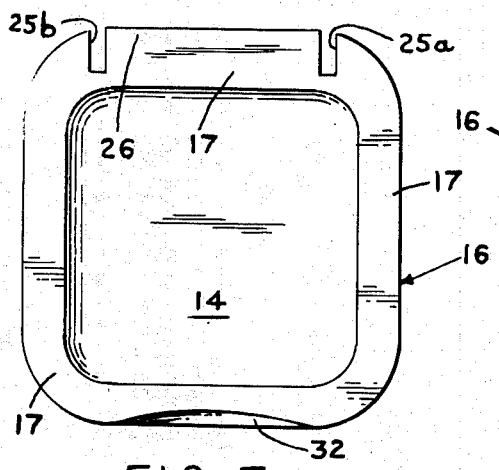
FIG. 7*a* is an inverted plan view of the base member of the container shown in FIG. 1 with the cover or top member removed.
Figure 7B:
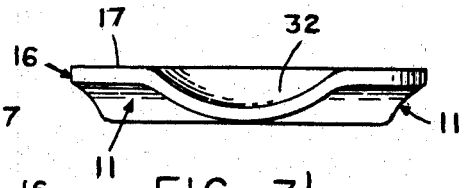
FIG. 7*b* is a front view of the base member with the cover removed as shown in FIG. 7*a*.
Figure 7D:
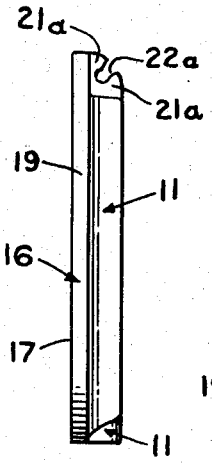
FIG. 7*d* is a right side view of the base member with the cover removed as shown in FIG. 7*a*.
Figure 7C:
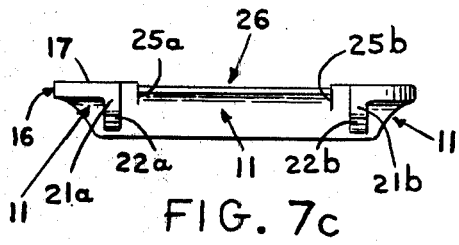
FIG. 7*c* is a rear view of the base member with the cover removed as shown in FIG. 7*a*.

In operation after the closure 12 has the pins 24*a* and 24*b* affixed to the snap openings 22*a* and 22*b* to pivotally connect the closure 12 to the base 11 as has been above described, it can be rotated about the axis formed by the hinge from the open position to the closed position as shown in FIGS. 6*a* and 6*b*. During the course of which movement it will pass through an intermediate position as shown by FIG. 6*b* and 6*c*.

By reference to FIGS. 6*a*, 6*b* and 6*c* it will be noted that as the closure or top member 12 moves from the open to the closed position that the curved cove section 29 of the latch section 28 on the closure member 11 will come into contact with a rounded edge 31 on the spring latch 26. As the closure member 11 is pivoted further towards the closed position so that it overlies the base 11, the latch section 28 will ride up and over the rounded edge 31. Due to the increased thickness D of the edge 30 on the latch section 28, the latch section 28 will exert an additional force against the spring leaf 26 and will deform or place the spring leaf 26 under stress or compression. The force exerted against the front end of the closure 11 must be great enough to establish a moment of force sufficient to overcome the frictional engagement between the curved cove section 29 and the rounded edge 31 and the resilient characteristic of the material from which the spring latch 26 is formed. By reason of the resiliency of the spring latch 26 it will be deformed and compressed and in the compressed state will act to exert a counter force against the associated edge 30 of the latch 28 on the closure 12 to hold the same in the closed position as shown in FIG. 6*a* of the drawings.

As the closure 12 is moved to this closed position when the spring leaf 26 is deformed so as to place the same under stress and compression an audible click or snapping sound will be heard.

It is though clear from the description of the movement of the closure 12 from open to closed position that a predetermined force must be exerted for accomplishing this purpose. When the closure 12 is in the closed position and the force being exerted is removed, the compressed spring tab or spring leaf 26 will expand slightly and will therefore exert the necessary force against the closure to maintain the same in the closed position until it is desired to move the closure to open position.

When it is necessary to open the compact 10 the user can insert a fingernail or the end of a finger into the undercut section 32 on the front side of the compact remote from the spring latch and hinge assembly 20 and by exerting a relatively light force to overcome the compression forces acting in the spring leaf 26 lift the closure from the closed to the open position which movement releases the spring tab or spring leaf 26 from the compressed state and permits it to return to the undeformed position as shown in FIG. 6*b* and this closing and opening procedure can be followed whenever the user desires to once again seal the chamber or receptacle 14 in the base or bottom member 12 or open the same for further use.

The spring latch and hinge assembly 20 of the form of the invention above described provides various ways in which the resiliency of the spring latch 26 and the forces that are exerted can be adjusted between relatively wide variations for devices of this type. This is desirable in the case of compacts for cosmetics to which the improved spring latch and hinge assembly in accordance with the present invention is particularly applicable.

The factors which have bearing on this interrelationship of resiliency to force exerted are the coefficient of elasticity of the material from which the container or compact are made and the memory i.e. the ability to return to the former non-compressed state; the radius of curvature of the peripheral end 31 of the spring leaf and the associated radius of curvature of the curved cove section 29 on the latch section 28 of the closure member; the difference between the plane of the rim edge 30 on the latch section of the closure 11 and the plane of the annular rim section 19 thereof; the relative length of the depending pin supports, and the moment of force established by the length of the front section of the closure 11 from the axis of rotation formed by the pin members of the hinge elements.

ANOTHER FORM OF THE PRESENT INVENTION

Referring now to FIGS. 9 to 15 of the drawings which show a cover spring latch and hinge assembly for a container representing an alternate form of the invention.

In this form of the invention the container is also in the form of a compact generally designated 110 molded as stated in the earlier form of the invention from plastic materials having the strength and thermal plastic memory to provide the improved resilient latch and hinge assembly in accordance with the present invention.

Thus, the compact 110 has a base or bottom member 111 and a closure or top member 112 which are operatively and pivotally connected to each other by means of said improved resilient latch and hinge assembly generally designated 120 as is more fully described hereinafter.

The compact 110 is shown as rectangular in plan view. It is again noted that while the compact is illustrated as rectangular in plan view that those skilled in the art will understand that the shape and size of the particular container which utilizes the improved resilient latch and hinge assembly in accordance with the present invention will be in accordance with the commercial requirements for devices of this type.

Base or bottom member 111 includes a center section 113 which defines a receptacle 114 having an opening 115 about the upper end of the center section 113. The upper end of the central section 113 has a beveled sealing surface as at 116 and at the front end a stop shoulder 117 is formed to coact with the closure member 112 as is shown at FIGS. 11, 13, 14*a* and 14*b* of the drawings.

Figure 14A:
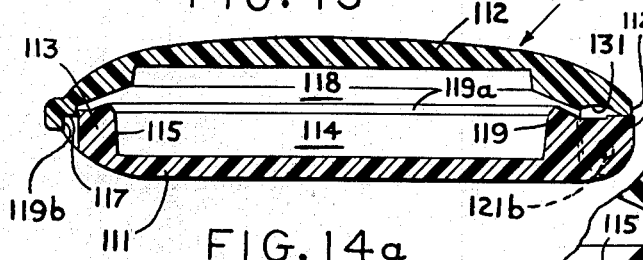
FIG. 14*a* is a cross-section taken on lines 14*a*—14*a* of FIG. 12 showing the base or top member and the closure or bottom member in the closed position.

Since closure or top member 112 is rectangular in plan view it forms a semi-cylindrical cavity 118 for various purposes and about the cavity 118 has an annular rim section as at 119 which is modified at the back or rear end to permit the closure or top member 112 to be pivotally connected to and operatively associated with the base or bottom member 111 by means of the improved spring latch and hinge assembly 120 so that it can pivot alternatively to an open position to permit access to the opening 115 for the chamber or receptacle 114 and to a closed position wherein a beveled face as at 119*a* between the cavity 118 and the annular rim 119 is provided to coact with the beveled upper surface 116 of the base or bottom member 111 to maintain the opening 115 substantially closed in the closed position as is clear from FIG. 14*a* of the drawings.

Figure 14B:
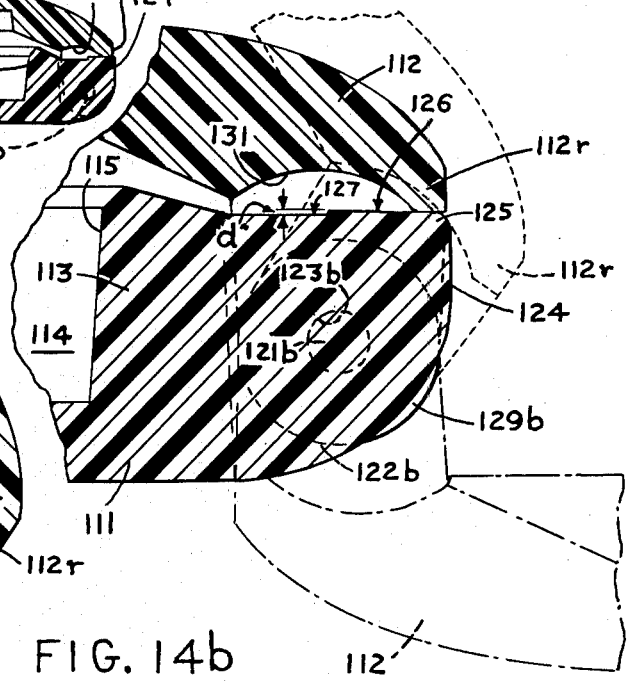
FIG. 14*b* is a partial enlarged cross-section taken at the spring clasp and hinge assembly and of the container as shown in FIG. 14*a* with the closure or top member shown relative the base or bottom member in the intermediate position by the phantomized dashed lines and in the open position by the phantomized dashed and dotted lines.
Figure 14C:
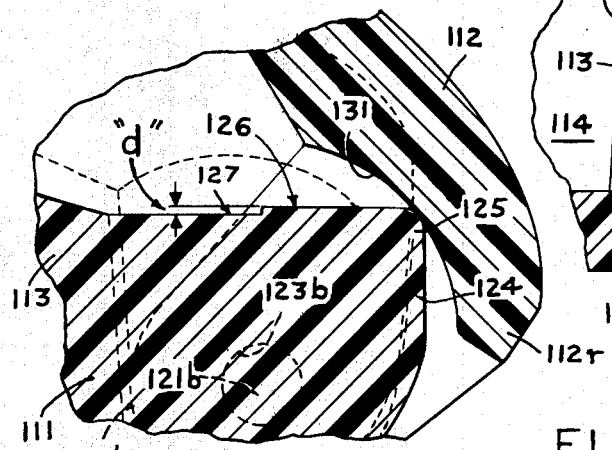
FIG. 14*c* is a still further enlargement of the cross-section of the resilient spring latch on the container shown in FIG. 14*a*.
Figure 15A:
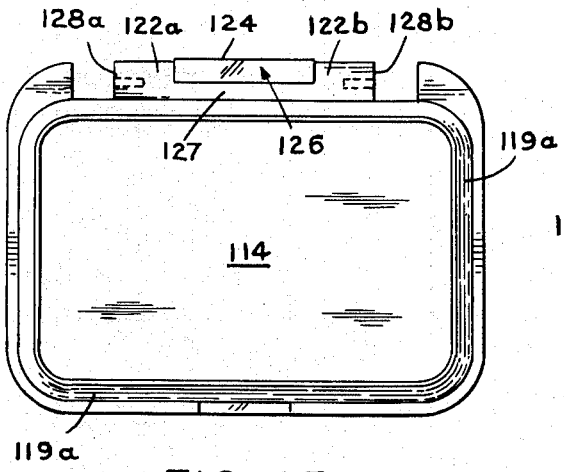
FIG. 15*a* is an inverted plan view of the base member on the container shown in FIG. 9 with the cover or top member removed.
Figure 15B:
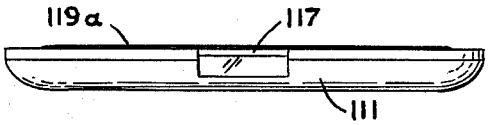
FIG. 15*b* is a front view of the base member with the cover removed as shown in FIG. 15*a*.
Figure 15C:
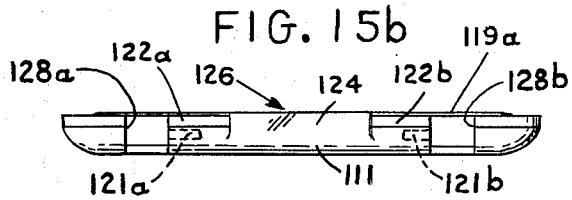
FIG. 15*c* is a rear end view of the base member with the cover removed as shown in FIG. 15*a*.
Figure 15D:
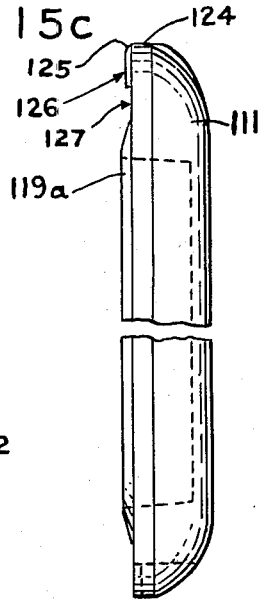
FIG. 15*d* is a right side view of the base member with the cover removed as shown in FIG. 15*a*.

Further the front end at 119*b* forms an L-shaped groove which is adapted to engage the stop shoulder 117 on the corresponding associated front edge of the base or bottom member 111 as is also shown in FIGS. 14*a* and 14*b* of the drawings.

FIGS. 1, 2, 3 and 14*a* to 16*c* inclusive show that in this form of the invention the improved spring latch and hinge assembly 120 includes shaft type hinges wherein the respective hinge elements are molded as integral parts of the respective base member 111 and closure member 112 so they can be connected to rotate on the associated hinge shaft pins at 121*a* and 121*b*.

Thus in the rear or back side 111*r* of the base or bottom member 111 spaced inboard hinge members are formed as at 122*a* and 122*b* with aligned hinge pin shaft openings extending therethrough as at 123*a* and 123*b*. Between the inboard hinge members 122*a* and 122*b* a sized and solid boss 124 is formed continuous and integral with the associated rear end 111*r* of the base or bottom member 111, the boss 124 being so fixed that it is not resilient for reasons that will appear clear when the operation of this form of the invention is described. Further the boss 124 is rounded at its outer peripheral edge as at 125 and its upper face has a raised flat section as at 126 positioned or disposed a predetermined space distance "d" above the peripheral surface 127 of the rim 119 on the upper end of the central section 113 of the base or bottom member 111.

Figure 3:
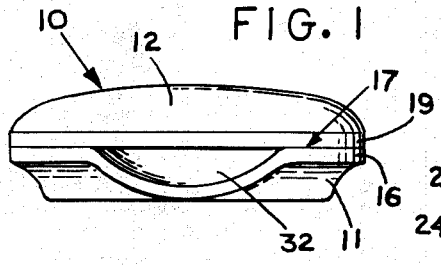
FIG. 3 is a front view of the container shown in FIG. 1.
Figure 4:
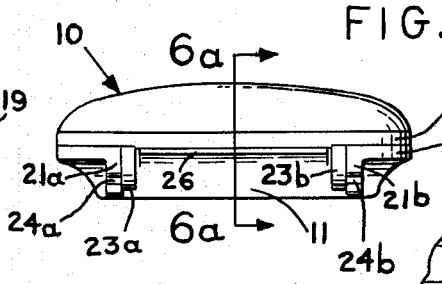
FIG. 4 is a rear view of the container shown in FIG. 1.
Figure 4A:
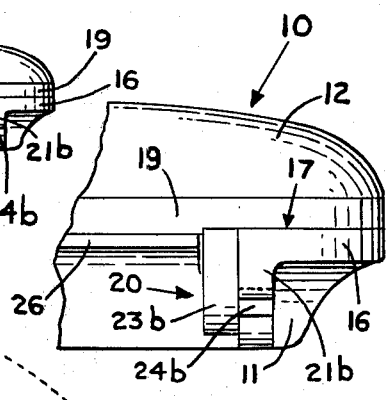
FIG. 4*a* is an enlarged view of one hinge and a portion of the spring latch adjacent thereto on the container as shown in FIG. 4.
Figure 5:
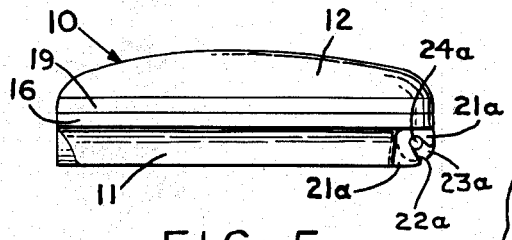
FIG. 5 is a right side view of the container shown in FIG. 1.
Figure 16A:
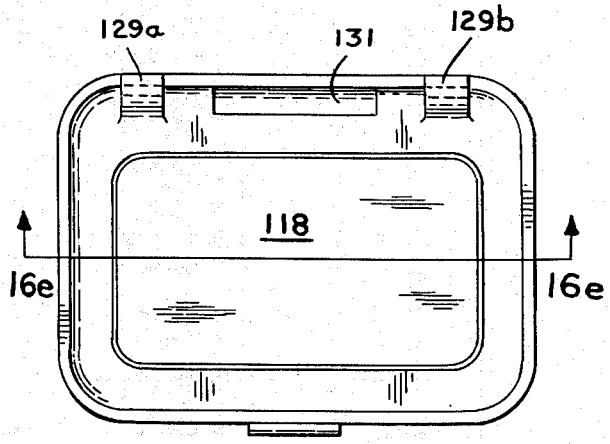
FIG. 16*a* is an inverted plan view of only the closure or cover member of the container shown in FIG. 9.
Figure 16B:
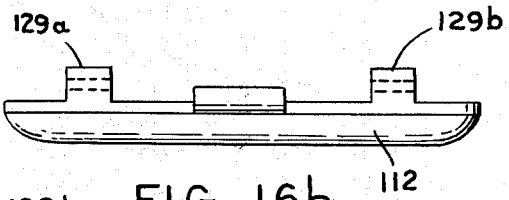
FIG. 16*b* is a front view of the closure or cover member shown in FIG. 16*a*.
Figure 16C:
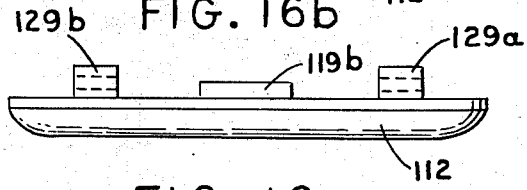
FIG. 16*c* is a rear view of the closure or cover member shown in FIG. 16*a*.
Figure 16D:
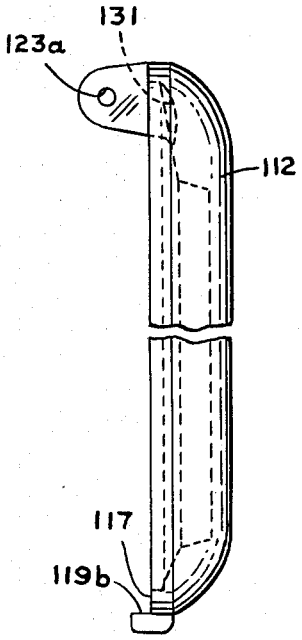
FIG. 16*d* is a right side view of the closure or cover member shown in FIG. 16*a*.
Figure 16E:
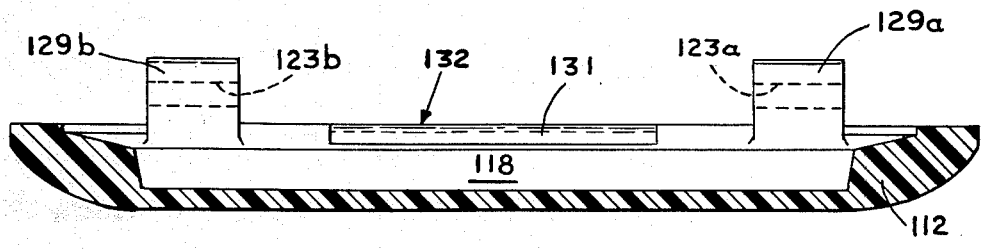
FIG. 16*e* is a cross-section taken on line 16*e*—16*e* of FIG. 16*a*.

Spaced outwardly of the inboard hinges 122*a l and* 122*b* are spaced recesses as at 128*a* and 128*b* all of which is shown in FIGS. 1, 3, 14*a*, *b* and *c* and FIG. 16*a* of the drawings.

On the closure member 112 the spaced coacting outboard hinge members 129*a* and 129*b* are formed on centers which correspond to the respective centers of the based recesses 128*a* and 128*b*. The spaced outboard hinged members 129*a* and 129*b* depend downwardly from the rear end section 112*r* of the annular rim 119 and are molded and formed continuous therewith and are provided with aligned hinge pin shaft openings as at 130*a* and 130*b* so that when the hinge members 129*a* and 129*b* are aligned and fitted into the spaced recesses 128*a* and 128*b* hinge pins 121*a* and 121*b* can be pressed through the respective lined hinge pins shaft opening at 122*a* and 130*a* for one set of hinge elements and 122*b* and 130*b* for the other set of hinge elements as is shown in FIGS. 10, 14*a*, 16*b* and 14*b* of the drawings.

As in the earlier form of the present invention it will be readily apparent to those skilled in the art that if the conventional interference catch of some type is not provided at the front edge of the compact shown in FIGS. 9 to 16 of the drawings that the closure 112 will not be held in closed relationship with the base or bottom member 111 so as to seal the opening 115 for the receptacle 114 therein.

This however is accomplished in the form of the invention illustrated at FIGS. 9 to 16 of the drawings by modifying the rear section 112*r* of the closure member between the outboard hinge members 129*a* and 129*b* so that the same is resilient and by providing it with a curved cove section as at 131 so that as this modified rear section 112*r* of the closure 112 is pivoted from the open position shown in phantomized dashed and dotted lines in FIGS. 14*b* through the intermediate position also shown in FIG. 14*b* in phantomized dashed lines, the curved cove section 131 will engage the rounded edge 125 of the boss 124.

At some point during the movement from the open position to the closed position shown at FIGS. 14*a* and 14*b* of the drawings the rear section 112*r* will be brought into frictional engagement with the portion of the rounded section 125 and the raised flat section 126 on the boss 124 and in order to overcome the frictional engagement manual force will be exerted on the front end of the closure or top member 112 until the resilient rear section 112*r* bows or compresses sufficiently to permit the closure member 112 to move over the raised flat section 126 to the closed position where the rear section 112*r* of the closure member will then engage the flat surface 126 on the boss 124.

In this closed position the resilient section 112*r* will tend to expand from the compressed state and the counter forces on the closure 112 will exert and maintain forces on the front end so that the L-shaped edge 119*b* will engage the stop shoulder 117 on the base or bottom member 111 and the closure 112 will remain in this closed position until force is exerted on the L-shaped edge 119*b* to overcome the compressive forces acting at the resilient section 112*r* on the closure member 112 thus permitting the closure member 112 to now be moved to the open position. Since movement of the closure member to the open position will release the compressive forces acting in the modified rear section 112*r*, the rear section will be released from the compressed state and will return to the undeformed position as shown in FIG. 14*b* so that the process of opening and closing this form of the compact can be repeated as many times as may be required whenever the user desires to once again seal the chamber or receptacle 113 in the base member 111.

As in the first form of the invention, as the closure or cover member 112 moves from open to closed position and vice versa, an audible clicking noise will be heard.

The spring latch and hinge assembly 120 of this form of the invention provides various ways in which the resiliency of the spring latch formed by the cover and boss and the forces that are exerted can be adjusted between these elements. More particularly the strength of the boss, the relevant resiliency of the cover 112 and the relationship between the clearances of the upper face of the boss and curvature of the rounded peripheral edge and the curved cove section are factors which can be taken into account for the desired adjustment of this form of the invention.

While the foregoing description illustrates various preferred embodiments of apparatus and systems in accordance with the present invention, it will be appreciated that certain changes and modifications may be made in the structure of these disclosed arrangements without departing from the spirit and scope of the invention and that the same is defined by the claims as hereinafter set forth.

What is claimed is:

1. A spring latch and hinge assembly for a closure member pivotally connectible to a base member includes, a. spaced hinge means including hinge elements connected respectively to the closure member and the base member to permit movement of the closure member to a full open position, b. resilient means disposed between the spaced hinge means, c. latch means disposed between the spaced hinge means to coact with the resilient means, d. said resilient means has a rounded peripheral edge, e. said latch means has a concave section inwardly of the end thereof disposed to engage the rounded end of the resilient means on movement of the closure member from full open to closed position and vice versa, and f. an incremental section disposed for operative association between the resilient means and the latch means, and adjacent their peripheral edges so that a force must be exerted on the closure member during closing movement to compress the resilient means whereby said resilient means will exert a counterforce to prevent said closure member moving from the closed to the open position.

2. A spring latch and hinge assembly for a closure member pivotally connectible to a base member includes, a. spaced hinge supports connected to said base member, b. spaced coacting hinge elements on the closure member connectible to said spaced hinge supports to pivotally connect said closure member to the base member for movement from full open to closed position and vice versa relative said base member, c. resilient means connected to said base member between the spaced hinge supports thereon, d. latch means connected to said closure member between said spaced hinge elements thereon and disposed to coact with the resilient means in assembled position thereon, and e. an incremental section disposed for operative association between the resilient means and the latch means, and adjacent their peripheral edges so that a force must be exerted on the closure member during closing movement to compress the resilient means whereby said resilient will exert a counterforce to prevent said closure member moving from the closed position to the open position.

3. In the spring latch and hinge assembly for a closure member as claimed in claim 2 wherein, a. the resilient means has a rounded peripheral edge, b. the latch means has a concave section inwardly of the end therof disposed to engage the rounded peripheral edge of the resilient means on movement of the closure member from full open to closed position and vice versa, and c. said incremental additional section is disposed on the latch means outboard of the concave section to engage adjacent the peripheral edge of the resilient means on closing movement of the closure member.

4. In a spring latch and hinge assembly for a closure member as claimed in claim 2 wherein the coaction between the resilient means and the latch means produces an audible sound.

5. In a spring latch and hinge assembly for a closure member as claimed in claim 3 wherein the incremental extra section on the end of the latch member is in the order of 0.010".

6. In a spring latch and hinge assembly for a closure member pivotally connectible to a base member wherein, a. said base member includes, a cylindrical central portion defining a space to contain material such as cosmetics therein, an annular rim section formed about the said cylindrical central portion, and said annular rim section has a substantial flat upper face, b. spaced hinge supports formed on said annular rim section, c. spaced hinge elements on the closure member connectible to said spaced hinge supports to pivotally connect said closure member to the base member for movement from a full open to a closed position relative the said base member and vice versa, d. a sized and raised non-resilient boss on the outer edge of the annular rim section between the spaced hinge supports, e. resilient means formed on said closure member between the spaced hinge elements, f. said resilient means disposed for operative engagement with the raised non-resilient boss on the base member, g. the raised non-resilient boss on the base member has a rounded peripheral edge, h. the resilient means formed on the closure member has a concave section inwardly of the end thereof disposed to engage the rounded peripheral edge of the non-resilient boss on movement of the closure member from open to closed position and vice versa, and i. said raised non-resilient boss to exert compressive forces on the resilient means during closing movement of the closure member whereby the resilient means on the closure member will exert a counterforce to permit said closure member from moving from closed to open position.

7. In the spring latch and hinge assembly for a closure member as claimed in claim 6 wherein the raised non-resilient boss is raised approximately 0.010" relative the adjacent flat upper surface of the annular rim section.

8. In a spring latch and hinge assembly for a closure member as claimed in claim 6 wherein the coaction between the raised non-resilient boss and the resilient means on the closure member produce an audible sound.

9. In a spring latch and hinge for a closure member pivotally connectible to a base member wherein, a. the base member has a cylindrical central portion defining a space to contain material such as cosmetics therein, and an annular flange mean formed about the upper end of the cylindrical central portion, b. spaced hinged means formed integrally with the cylindrical central portion and flange means, and having hinge pin supporting openings therein, c. slots on the flange means on the inboard side of the respective spaced hinge members to define a resilient means therebetween, d. said closure member having a pair of downwardly extending hinge pin supports sized and spaced to interfit into the slots in the flange means, and hinge pins on each of said hinge pin supports extending outwardly and in opposite directions and disposed to interengage with the hinge pin supporting openings in the hinge members to pivotally connect the closure member to the base member so as to overlie the material receiving opening therein, e. latch means formed on the cover member between the hinge pin supports, and f. means on said latch means disposed for operative engagement with the resilient means for normally maintaining said cover member in closed position.

10. In a spring latch and hinge assembly for a closure member as claimed in claim 9 wherein, a. said resilient means has a rounded peripheral edge, b. said latch means has a concave section inwardly of the end thereof disposed to engage the rounded end of the resilient means on movement of the closure member from open to closed position and vice versa, and c. said latch means has an incremental additional section outboard of the concave section to exert compressive forces on the resilient means during the closing movements of the closure member.

11. In a spring latch and hinge assembly for a closure member as claimed in claim 9 wherein the coaction between the resilient means and the latch means produces an audible sound.

12. In a spring latch and hinge assembly for a closure member as claimed in claim 10 wherein the incremental extra section on the end of the latch member is in the order of 0.010".

* * * * *